US010018198B2

(12) United States Patent
Hoppach

(10) Patent No.: US 10,018,198 B2
(45) Date of Patent: Jul. 10, 2018

(54) PUMP ARRANGEMENT HAVING TEMPERATURE CONTROL COMPONENTS

(71) Applicant: Magna Powertrain Bad Homburg GmbH, Bad Homburg (DE)

(72) Inventor: Elmar Hoppach, Bad Homburg (DE)

(73) Assignee: MAGNA POWERTRAIN BAD HOMBURG GMBH, Bad Homburg (DE)

( * ) Notice: Subject to any disclaimer, the term of this patent is extended or adjusted under 35 U.S.C. 154(b) by 425 days.

(21) Appl. No.: 14/380,947

(22) PCT Filed: Feb. 13, 2013

(86) PCT No.: PCT/EP2013/052799
§ 371 (c)(1),
(2) Date: Aug. 26, 2014

(87) PCT Pub. No.: WO2013/127626
PCT Pub. Date: Sep. 6, 2013

(65) Prior Publication Data

US 2015/0037181 A1 Feb. 5, 2015

(30) Foreign Application Priority Data

Feb. 27, 2012 (DE) ..... 10 2012 003 588

(51) Int. Cl.
*F04C 13/00* (2006.01)
*F04C 2/10* (2006.01)
(Continued)

(52) U.S. Cl.
CPC ..... *F04C 13/004* (2013.01); *F04C 2/10* (2013.01); *F04C 2/14* (2013.01); *F04C 11/008* (2013.01);
(Continued)

(58) Field of Classification Search
CPC ..... F04C 15/0003; F04C 15/0019; F04C 15/0057; F04C 15/0088–15/0096
(Continued)

(56) References Cited

U.S. PATENT DOCUMENTS 2,761,078 A 8/1956 McAdam
5,145,329 A 9/1992 Zumbusch et al.
(Continued)

FOREIGN PATENT DOCUMENTS

DE 102007035239 A1 1/2009
DE 102009028098 A1 2/2011
(Continued)

OTHER PUBLICATIONS

International Written Opinion.
International Search Report dated Feb. 18, 2014.

*Primary Examiner* — Essama Omgba
*Assistant Examiner* — Stephen Mick
(74) *Attorney, Agent, or Firm* — Dickinson Wright PLLC

(57) ABSTRACT

Pump arrangement (20) for conveying a fluid, with a housing (22), with a first rotatably mounted pump member (24), and with a second rotatably mounted pump member (26), wherein a fluid-conveying effect is produced by means of a relative rotary movement between the first and the second pump member (24, 26), wherein the first pump member (24) can be driven by an electric motor (42) which is arranged concentrically to the first pump member (24) and which has a stator (44) and a rotor (46), wherein the rotor (46) is fixed to the first pump member (24) and wherein the pump arrangement (20) is constructed in such a way that fluid is present in an annular gap (58) between the rotor (46) and the stator (44). In this case, the pump arrangement has temperature control means for heating the fluid in the annular gap (58).

18 Claims, 2 Drawing Sheets

(51) Int. Cl.

| | |
|---|---|
| ***F04C 11/00*** | (2006.01) |
| ***F04C 14/06*** | (2006.01) |
| ***F04C 15/00*** | (2006.01) |
| ***F04C 2/14*** | (2006.01) |

(52) U.S. Cl.
CPC ..... *F04C 14/06* (2013.01); *F04C 15/0096* (2013.01); *F04C 2240/54* (2013.01)

(58) Field of Classification Search
USPC ..... 417/420
See application file for complete search history.

(56) References Cited

U.S. PATENT DOCUMENTS

| | | | | |
|---|---|---|---|---|
| 5,670,852 | A * | 9/1997 | Chipperfield | F04B 49/06 318/250 |
| 5,890,885 | A * | 4/1999 | Eckerle | F04C 15/0019 418/168 |
| 6,007,312 | A * | 12/1999 | Pieters | F04D 13/022 29/607 |
| 7,215,052 | B2 * | 5/2007 | Blase | F02M 37/08 310/254.1 |
| 8,113,794 | B2 * | 2/2012 | Schneider | F04C 2/084 310/156.38 |
| 9,435,383 | B2 * | 9/2016 | Parrett | F04C 2/1073 |
| 2003/0193250 | A1 * | 10/2003 | Maslov | H02K 1/141 310/68 R |
| 2004/0140725 | A1 * | 7/2004 | Takahashi | H02K 1/2786 310/156.21 |
| 2007/0040524 | A1 * | 2/2007 | Sarlioglu | H02P 21/0089 318/438 |
| 2007/0071596 | A1 * | 3/2007 | Ryser | A61M 5/142 415/172.1 |
| 2009/0175751 | A1 * | 7/2009 | Nakayoshi | F04C 2/086 418/171 |
| 2010/0158724 | A1 * | 6/2010 | Ihle | F04D 13/06 417/423.7 |
| 2011/0217192 | A1 * | 9/2011 | Rosalik, Jr. | F04C 2/10 417/410.4 |
| 2012/0313492 | A1 * | 12/2012 | Yamada | H02K 1/24 310/68 D |
| 2013/0333870 | A1 * | 12/2013 | Bishop | C22C 1/0416 165/185 |

FOREIGN PATENT DOCUMENTS

| | | | |
|---|---|---|---|
| DE | 102009028148 | A1 | 2/2011 |
| DE | 102009045049 | A1 | 3/2011 |
| DE | 102010029338 | A1 | 12/2011 |
| DE | 102011012586 | A1 | 12/2011 |
| EP | 1674728 | A2 | 6/2006 |
| JP | 2005098268 | A | 4/2005 |
| WO | 2008017543 | A1 | 2/2008 |
| WO | 2010037703 | A2 | 4/2010 |
| WO | 2011012364 | A2 | 2/2011 |
| WO | 2013127626 | A2 | 9/2013 |

* cited by examiner

PUMP ARRANGEMENT HAVING TEMPERATURE CONTROL COMPONENTS

CROSS-REFERENCE TO RELATED APPLICATIONS

This application is a U.S. National Stage of International Application No. PCT/EP2013/052799 filed Feb. 13, 2013 and which claims the benefit of and priority to German Application No. 102012003588.8 filed Feb. 27, 2012. The entire disclosure of each of the above applications is incorporated herein by reference.

FIELD

The present invention relates to a pump arrangement for delivering a fluid, in particular an oil, with a housing, and with a first rotatably mounted pump member, with a second rotatably mounted pump member, wherein a fluid delivering effect is produced by means of a relative rotary movement between the first and the second pump member, wherein the first pump member can be driven by an electric motor, which is arranged concentrically with the first pump member and which has a stator and a rotor, wherein the rotor is fixed on the first pump member and wherein the pump arrangement is constructed in such a way that fluid is present in an annular gap between the rotor and the stator.

BACKGROUND

Pump arrangements of this kind are widely known, particularly as oil pumps for motor vehicle transmissions. In particular, pump arrangements of this kind are known as gear pumps with internal toothing, and these can be designed with or without a crescent. In particular, the present invention relates to gear pumps with internal toothing without a crescent, which are also known as annular gear pumps or gerotor pumps.

Document DE 10 2009 026 148 A1 discloses a gear pump for fuel in which an outer pump member is produced from a plastic or from a sintered steel, wherein magnets or holes are embedded in the material. The pump member thus forms the rotor of an electric motor, the stator of which carries on its inner circumference a sliding bearing produced from a non-ferromagnetic material, such as bronze.

Document WO 2011/012364 A2 furthermore discloses a gear pump for fuel in which a magnet ring is fixed on the outer circumference of an outer pump member. The sliding bearing arrangement of this pump member is set up to achieve a thin annular gap between this pump member and a bearing ring connected to the housing.

The practice of fixing a bearing bush that forms a sliding bearing arrangement for a rotor on the inner circumference of a stator of a gear pump for fuel is furthermore known (DE 10 2010 029 336 A1).

Document WO 2008/017543 A1 furthermore discloses another internal gear pump for fuel, in which a magnet ring is connected to a toothed ring, wherein the magnet ring is accommodated rotatably in the stator in the manner of a sliding bearing. Here, it is supposed to be advantageous to coat the magnet ring in order to achieve a tribologically advantageous pairing of materials.

The publication EP 1 674 728 A2 discloses a pump arrangement in which a stator is arranged outside the actual pump housing.

In the above pump arrangements, the stator is in each case accommodated in a housing. U.S. Pat. No. 2,761,078 discloses the practice of not covering the stator plates at the outer circumference so as to allow better dissipation of heat developed in the stator to the outside. This document furthermore discloses the practice of filling the cavities between the stator poles of the stator with a plastic, thus ensuring that the inner circumference of the stator is closed between the pole shoes. Here, the plastic is to be selected so that it has a better thermal conductivity than air. The rotor of this pump arrangement is supported on the housing by means of bearings.

SUMMARY

Given this background, it is an object of the invention to specify an improved pump arrangement, said pump arrangement being improved particularly as regards cold starting behavior.

The above object is achieved by a pump arrangement of the type stated at the outset wherein the pump arrangement has temperature control means for heating the fluid in the annular gap.

Particularly in the case of fluids, the viscosity of which is high at low temperatures, the efficiency of a pump arrangement of this kind can be increased by such temperature control means. This is because the temperature control means can be used to rapidly heat the fluid present in the annular gap, especially when cold starting, thus reducing viscous friction in the annular gap. It is thereby possible to reduce the drive torque required during such a cold starting phase to operate the pump arrangement.

In general terms, it is possible to make the temperature control means active, such that special heating devices are provided in the annular gap to heat the fluid, wherein these heating devices are switched on during a cold starting phase and, if appropriate, can be switched off at a later time.

However, it is particularly advantageous if the temperature control means are designed in such a way that the heating of the fluid is accomplished by using the waste heat from the electric motor in order in this way to increase the fluid temperature in the annular gap. This kind of temperature control means requires essentially no components that can be switched on or off actively in addition, and therefore the pump arrangement can be implemented at low cost.

When the fluid present in the annular gap, which is preferably the same fluid that is to be delivered by means of the pump arrangement, has reached a sufficiently high temperature, the viscous friction in the annular gap is reduced and the rotor can be supported rotatably in the stator in the manner of a sliding bearing.

The object is thus fully achieved.

It is particularly advantageous if the temperature control means comprise the feature that the rotor has a lower thermal conductivity than the first pump member.

This measure avoids a situation where the heat arising from the operation of the electric motor is introduced into the first pump member, which can be formed as a heat sink owing to its mass and its material.

Accordingly, the heat produced by the electric motor is better used to heat the fluid in the annular gap. Moreover, the first pump member is generally in contact with the fluid present between the pump members, which likewise forms a heat sink owing to the low temperatures during a cold starting phase.

The measure comprising providing the rotor with a lower thermal conductivity than the first pump member consequently also serves to prevent a situation where, although the heat arising in the stator is passed via the annular gap, it is then dissipated directly via the arrangement comprising the first pump member and the fluid between the pump members, said arrangement forming a heat sink. In this embodiment, the rotor serves as it were as a "heat shield", which "reflects" the heat arising in the stator and consequently holds it in the annular gap in order to heat the fluid present there as quickly as possible in this way.

According to another preferred embodiment, the stator has at least one stator pole, on which an electric stator winding is arranged, wherein the temperature control means comprise the feature that the stator pole directly adjoins the annular gap.

In contrast to solutions in which a sliding bearing bush or the like, which generally has a heat insulating action, is arranged on the inner circumference of the stator, the proposal in the present case is thus to arrange the stator pole, which generally consists of a metal, to directly adjoin the annular gap. Consequently, the heat arising in the stator windings, which, owing to the close contact with the stator pole, is introduced into the latter, can be introduced directly into the annular gap.

This measure too leads to quicker heating of the fluid in the annular gap during cold starting of the pump arrangement.

The pump arrangement can be produced from any desired materials, but, as a particularly preferred option, the first pump member is produced from a metallic material, e.g. steel.

In this case, the second pump member is preferably likewise produced from such a metallic material. Particularly in the case of oil pumps for vehicle transmissions, in which the fluid temperature can be in a range of between −40° C. and more than 100° C. for example, the use of pump members made from a metallic material is particularly preferred.

The rotor is preferably designed as a ring element.

In particular, it is preferred if the rotor is designed as a ring element produced separately from the first pump member.

In this case, the rotor can be a reluctance rotor.

However, it is particularly preferred if the rotor has a plurality of magnets, which are distributed over the circumference and are preferably designed as permanent magnets.

In this embodiment, the electric motor can have a high efficiency.

It is furthermore particularly advantageous if the magnets are embedded in the rotor designed as a ring element. Here, it is possible, on the one hand, to construct the ring element as a composite component comprising a plastics or synthetic resin material or a ceramic material and a magnetizable material. It is possible here, depending on requirements, to magnetize a ring element of this kind in such a way that a suitable number of magnets is arranged in a manner distributed over the circumference of the ring element. In other words, the number and configuration of the magnets can be influenced by means of the magnetizing step. In this case, the magnets are preferably magnetized radially.

In the case of a composite ring element of this kind, the non-magnetizable composite material can ensure that the rotor has a relatively low thermal conductivity or at least a lower thermal conductivity than a first pump member connected thereto.

It is furthermore particularly advantageous if the rotor is formed with a heat insulating layer on the side facing the annular gap and/or on the side facing away from the annular gap.

The heat insulating layer can be applied as a separate layer to the ring element but can also be integrated into the ring element, wherein the heat insulating layer is formed by the non-magnetizable composite material, for example. It is preferred here if the heat insulating layer comprises a plastics material, a synthetic resin material and/or a ceramic material.

According to another embodiment, which is preferred overall, the number of pole pairs of the rotor is equal to the number of teeth of the first pump member or to an integral multiple thereof.

By means of this measure, it is possible to ensure that the magnetic field lines between adjacent poles (e.g. magnets) of the rotor fit into the tooth shape of the first pump member. For this purpose, the rotor is preferably aligned in a suitable manner in the circumferential direction with the first pump member, such that, for example, a pole (e.g. a magnet) is aligned in a circumferential direction with a tooth and/or a tooth gap ("outer kidney shaped recess") of the first pump member.

In this kind of embodiment of the rotor, the magnetic field lines which penetrate the first pump member can run substantially undisturbed in the first pump member, making it possible to improve the efficiency of the electric motor.

For example, the electric motor can have a combination of numbers of pole pairs of 12/14, in which the electric motor has a stator with twelve windings and a rotor with 14 rotor magnet poles. In this case the number of teeth (or the number of outer kidney shaped recesses) of the first pump member can be 7, for example. In annular gear pumps, the inner pump member generally has one tooth less than the outer pump member, and therefore in that case the second pump member preferably has 6 teeth (outer kidney shaped recesses).

In a corresponding manner, in the case of an electric motor with a combination of numbers of pole pairs of 9/10, the first pump member preferably contains five teeth (outer kidney shaped recesses).

According to another preferred embodiment, which forms a separate invention in conjunction with the preamble of claim 1, the housing has at least one first housing section and one second housing section, which are arranged on axially opposite sides of the pump members, wherein one of the housing sections is formed by a circuit board arrangement that is fluidtight with respect to the interior of the housing.

In this embodiment, the pump arrangement can be combined in a structurally simple manner with electronics, e.g. for controlling the electric motor, which are preferably integrated into the circuit board arrangement. Another advantage here can furthermore consist in that the fluid to be delivered between the pump members can be used to cool the electronics integrated into the circuit board arrangement (e.g. semiconductor power components). It is furthermore possible to improve the cold starting behavior of the pump arrangement since the heat of the electronics can contribute to heating the fluid.

Here, the circuit board arrangement preferably forms a pump running surface for the pump members. The circuit board arrangement can be produced from the material FR4 or from ceramics or from a composite material thereof, for example.

Overall, it is advantageous if the fluid contained in the annular gap has a highly temperature dependent viscosity and, in particular, is an oil of the kind used in vehicle transmissions and/or in steering gears and/or in internal combustion engines.

With this kind of fluid, the advantages according to the invention are especially significant. In general, however, it is possible also to deliver other fluids, e.g. fuel, urea etc., with a pump arrangement of the kind according to the invention.

In general, it is conceivable for the pump arrangement to be an internal gear pump with a crescent. However, it is particularly preferred if the pump arrangement is designed in such a way that the first and the second pump member form an annular gear pump or gerotor pump.

According to another embodiment, which is preferred overall, at least one rotor position sensor is arranged on the stator.

The rotor position sensor can be a magnetic sensor, such as a Hall sensor, for example.

By means of a rotor position sensor of this kind, the electric motor can be driven not only under open-loop control but also under closed-loop control. In other words, a rotary motion of the rotor of the electric motor can be produced with low losses.

It is furthermore particularly preferred if the space between at least two stator poles of the stator is filled with an electrically insulating material, such as a plastics or synthetic resin material.

In this case, the electrically insulating material should be temperature-stable. In the embodiment in which the stator poles directly adjoin the annular gap, an inner running surface of the stator in the circumferential direction is furthermore formed alternately by a stator pole and a section of the electrically insulating material. Here, the electrically insulating material prevents fluid from coming into contact with the windings of the stator. If at least one rotor position sensor is arranged on the stator, it is particularly preferred if said sensor is embedded in the electrically insulating material between the stator poles.

It is thereby possible for the rotor position sensor to be integrated structurally into the pump arrangement in a particularly advantageous way.

In the embodiment in which a housing section is formed by a circuit board arrangement, the electric connection of the rotor position sensor is furthermore relatively simple to implement since the electric connections thereof can be transferred directly into the circuit board arrangement through the insulating material.

As an alternative thereto, it is also possible to integrate the rotor position sensor into the circuit board arrangement. In this case, the structural design can be simplified even further.

It is self-evident that the features mentioned above and those which remain to be explained below can be used not only in the respective indicated combination but also in other combinations or in isolation without exceeding the scope of the present invention.

DRAWINGS

Illustrative embodiments of the invention are shown in the drawing and are explained in greater detail in the following description. In the drawing.

DETAILED DESCRIPTION

Figure 1:
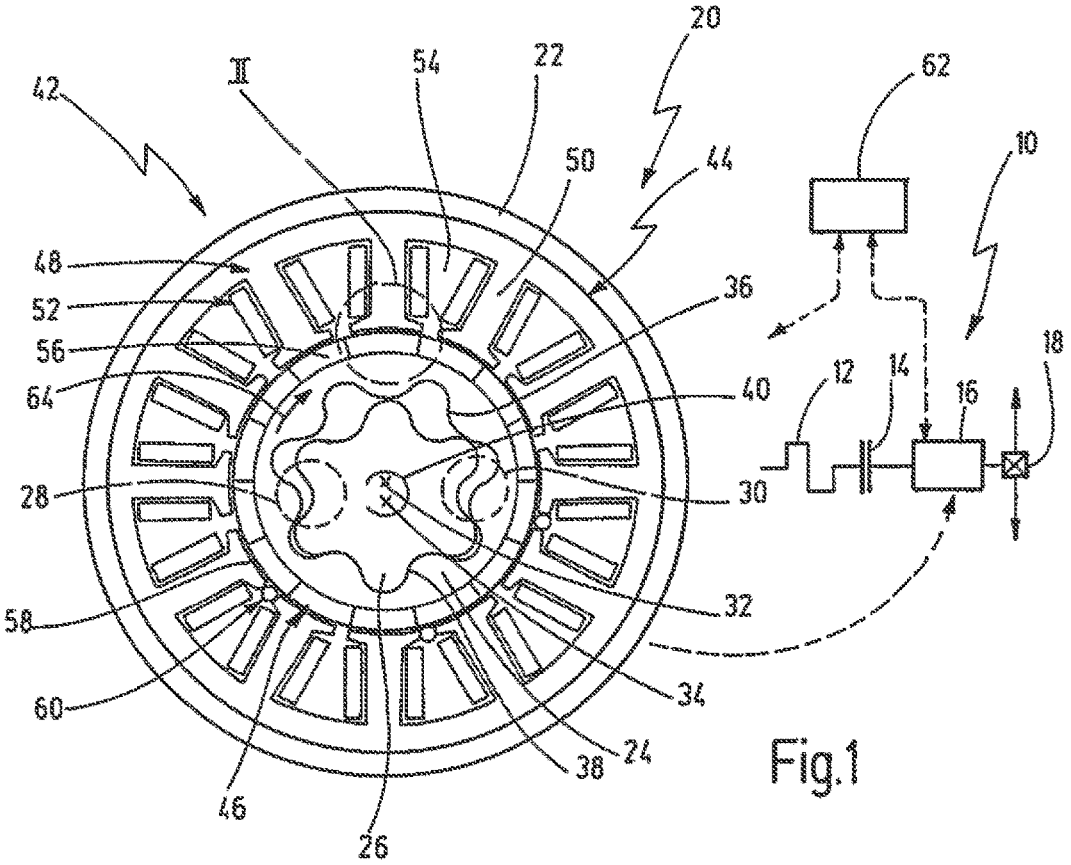
FIG. 1 shows a schematic axial view of one embodiment of a pump arrangement according to the invention and a drive train of a motor vehicle in which a pump arrangement of this kind can be used.

FIG. 1 shows a drive train for a motor vehicle in schematic form denoted in general by 10. The drive train 10 comprises a drive motor 12, such as an internal combustion engine, a clutch arrangement 14 and a transmission arrangement 16 and a power split arrangement 18, by means of which the motive power can be distributed to driven wheels.

In a drive train of this kind, it is necessary to deliver various fluids. This applies particularly to the oil for the internal combustion engine 12 and to the oil for a transmission 16.

Furthermore, in a drive train 10 of this kind delivered fluid is fuel for an internal combustion engine.

FIG. 1 shows in schematic form a pump arrangement 20 which is suitable for delivering such fluids, in particular for delivering fluids, the viscosity of which is highly temperature dependent, e.g. oil, especially transmission oil, such as ATF-oil or hypoid oil.

The pump arrangement 20 comprises a housing 22, which is substantially circular in cross section. The pump arrangement 20 furthermore has a first pump member 24 and a second pump member 26. In the present case, the pump members 24, 26 form an annular gear pump or an gerotor pump, wherein the first pump member 24 forms an outer rotor and the second pump member 26 forms an inner rotor.

The mode of operation of annular gear pumps or gerotor pumps of this kind is well known. Here, fluid is delivered from a schematically indicated suction port 28 to a schematically indicated discharge port 30 by initiating a relative rotary motion between the first and the second pump member 24, 26.

The first pump member 24 is coaxial with a first axis 32. The second pump member 26 is coaxial with the second axis 34, wherein the axes 32, 34 are radially offset with respect to one another. In the present case, the first pump member 24 has internal teeth 36 and, in the present case, the second pump member 26 has external teeth 38, wherein the internal teeth 36 and the external teeth 38 mesh in the manner of an annular gear pump. In particular, the tooth flanks of the internal teeth 36 and of the external teeth 38 are in the form of circular arcs or trochoids. In the present case, the first pump member 24 has seven teeth, between which an identical number of outer kidney shaped recesses is formed. The second pump member 26 has one tooth less and thus has six teeth and an identical number of kidney shaped recesses.

The second pump member 26 is supported rotatably on the housing 22. The support is indicated schematically by 40 in FIG. 1.

The pump arrangement 20 furthermore comprises an electric motor 42. The electric motor 42 has a stator 44 and a rotor 46. The stator 44 is fixed on the housing 22 and is arranged concentrically to the first pump member 24. The stator 44 comprises a stator core 48, on which a plurality of substantially radially aligned stator poles 50 are formed. Respective windings 52 are fixed on the stator poles 50. In the present case, the number of stator poles is 12.

The regions between the stator poles 50 and the windings 52 contained therein are filled with an electrically insulating material 54, which can be formed by plastic or by synthetic resin, for example.

The rotor 46 comprises a plurality of magnet poles 56, in the present case 14 magnet poles, which are arranged in a manner distributed over the circumference and are preferably magnetized radially. In this case, the rotor 46 is preferably designed as a ring element and is arranged on the outer circumference of the first pump member 24 and connected to the latter for conjoint rotation, e.g. by press fitting, by adhesive bonding or similar.

An annular gap 58 is set up between the rotor 46 and the stator 44. The design of the pump arrangement 20 is such that the fluid to be delivered between the pump members 24, 26 is also situated in the annular gap 58. This makes it possible to avoid complex seals in the region of the annular gap.

The stator 44 is designed in such a way that the stator poles 50 thereof directly adjoin the annular gap 58. Consequently, the inner circumference of the stator is formed alternately by stator poles 50 and electrically insulating material 54. This inner surface is designed or machined in such a way that it can form a kind of sliding bearing for the rotor 46.

At least one rotor position sensor 60, by means of which the rotor position can be detected, is provided in the region between two stator poles 50.

FIG. 1 furthermore schematically illustrates a control device 62, which is designed to control the drive train 10 and/or the pump arrangement 20. It is self-evident that the rotor position sensor 60 can be connected to a control device 62 of this kind.

During the operation of the pump arrangement 20, the electric motor 42 is operated in such a way that the rotor 46 rotates together with the first pump member 24 in a direction of rotation 64 relative to the housing 22 and the second pump member 26, as indicated at 64. Thereby, a delivery effect of the fluid from the suction port 28 to the discharge port 30 is initiated.

Figure 2:
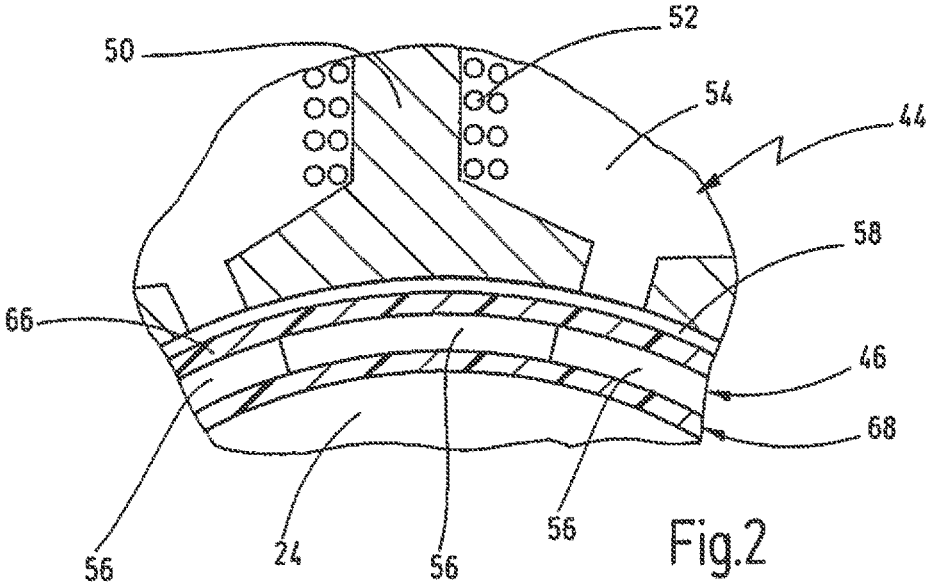
FIG. 2 shows a schematic detail view II of FIG. 1.

FIG. 2 shows a detail view II of FIG. 1.

It can be seen here that the rotor 46 is formed by a plurality of magnets 56, on the radial outer side of which a first heat insulating layer 66 is formed and on the radially inner side of which a second heat insulating layer 68 is formed.

At low temperatures, such as those which can occur in motor vehicle drive trains, fluid present in the annular gap 58 can have a very high viscosity, with the result that the cold starting behavior in the case of prior art gerotor pumps can be problematic.

In the present case, the heat which arises in the windings 52 during a cold start is passed into the stator poles 50 and, from there, is fed directly to the fluid in the annular gap 58, with the result that the latter warms up quickly, thereby reducing the viscosity.

By means of the first heat insulating layer 66 and/or by means of the second heat insulating layer 68, it is furthermore achieved that the heat remains substantially in the annular gap 58 and is not dissipated directly to the first pump member 24 and to fluid in contact therewith. This too leads to rapid heating of the fluid in the annular gap, thus, improving the cold starting behavior of the pump arrangement 20.

Figure 3:
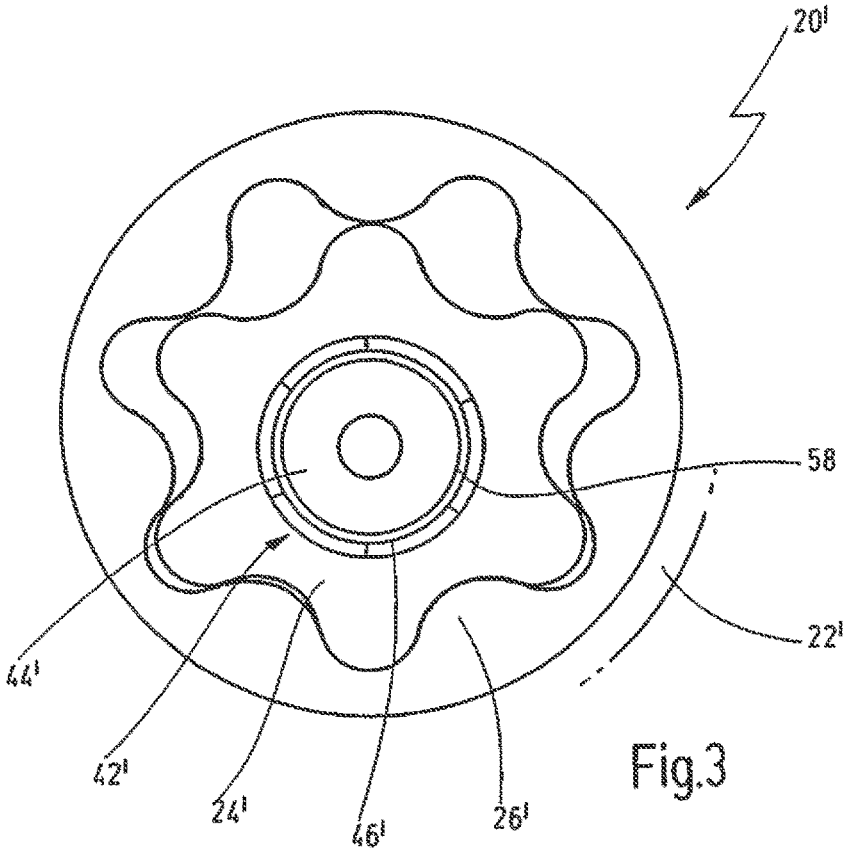
FIG. 3 shows a schematic axial view of another embodiment of a pump arrangement according to the invention.

FIG. 3 shows an alternative embodiment of a pump arrangement 20', which corresponds in general terms as regards construction and operation to the pump arrangement 20 in FIGS. 1 and 2. Identical elements are therefore denoted by identical reference signs. In the following the differences are mainly explained.

In the present case, the pump arrangement 20' is designed in such a way that the first pump member 24' is the inner rotor and the second pump member 26' is the outer rotor. In this case, the electric motor is arranged concentrically with the inner rotor 24', while, in this case, the electric motor 47 is designed as an external rotor motor, which has a stator 44' situated radially on the inside and a rotor 46' situated radially on the outside. In this case too, temperature control means for the rapid heating of the fluid in the annular gap 58 can be designed identically or in a similar way to those described above with reference to FIGS. 1 and 2.

Figure 4:
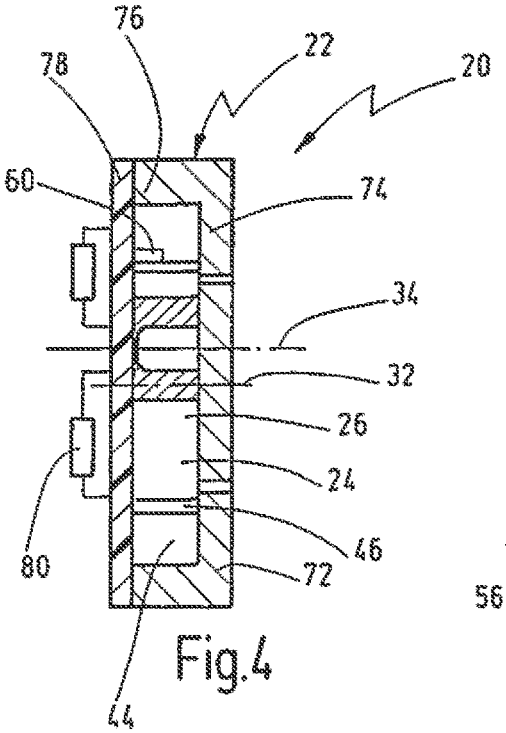
FIG. 4 shows a schematic axial section through another embodiment of a pump arrangement according to the invention.

FIG. 4 shows another alternative embodiment of a pump arrangement 20, which can correspond in general terms as regards construction and operation to one of the pump arrangements in FIGS. 1 to 3. Identical elements are therefore denoted by identical reference signs. In the following the differences are mainly explained.

The pump arrangement 20 in FIG. 4 comprises a housing 22, which has a first housing section 72. The first housing section 72 comprises a radial section 74, which is arranged on one axial side of the pump arrangement. Furthermore, the first housing section 72 has a substantially cylindrical axial section 76, which is connected integrally to the radial section 74 and surrounds the pump arrangement at the outer circumference.

Furthermore, the housing 22 has a second housing section 78, which is arranged on the axially opposite side of the pump arrangement and is connected in the manner of a cover to the first housing section 72 in order to surround the pump arrangement in a fluid-tight manner.

In the present case, the second housing section 78 is designed as an electric circuit board arrangement, which can be produced from a material such as FR4 or ceramics. The circuit board arrangement is configured so as to be fluid-tight with respect to the interior of the housing 22. Here, the circuit board arrangement 78 preferably forms an axial running surface for the pump members 24, 26.

It is furthermore shown in FIG. 4 that a rotor position sensor 60, which is embedded in an electrically insulating material 54, can be connected directly to the circuit board arrangement 78. As an alternative, it is possible to integrate a rotor position sensor 60 into the circuit board arrangement 78.

Electronic components can be provided on the axially outer side of the circuit board arrangement 78, as indicated schematically at 80.

At the same time, the circuit board arrangement 80 can also comprise power-carrying components, such as power transistors for example. These can preferably be arranged on the circuit board arrangement 78 in such a way that they are connected in the circumferential direction and/or in the radial direction with the spatial zone of the pump arrangement in which the fluid is delivered from the suction port to the discharge port. Thereby, the fluid can contribute to the cooling of the electronic or electric components on the circuit board arrangement 78. It is furthermore possible to improve the cold starting behavior of the pump arrangement since the heat of the electronics can contribute to heating the fluid.

The electric components 80 can also be integrated into such a circuit board, this preferably being designed with buried wires.

Figure 5:
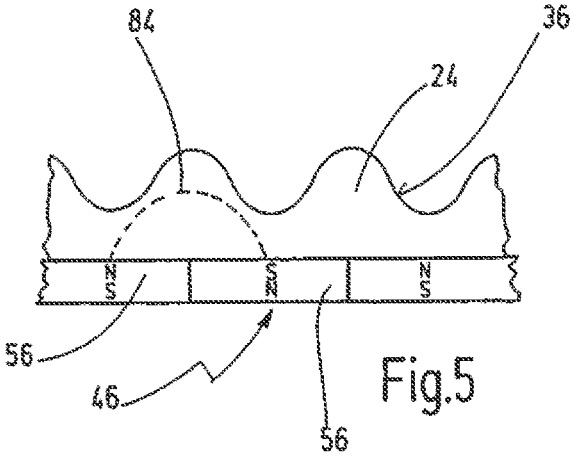
FIG. 5 shows a schematic development of a rotor and of a first pump member connected thereto to illustrate the field line profile within the first pump member given a suitable choice of the number of pole pairs and of teeth of the first pump member.

FIG. 5 shows a schematic development of the rotor 46 and of the first pump member 24 connected thereto in FIGS. 1 and 2.

The number of magnets 56 corresponds here to the number of teeth of the first pump member 24. The poles of the magnets are each arranged in the region of a tooth base of the internal teeth 36. In the first pump member 24, this leads to a field line profile between the adjacent permanent magnets of the kind indicated by way of example as a single field line 84 in FIG. 5. Substantially, the field line profile 84 coincides with the profile of the contour of a tooth of the internal teeth 36, with the result that the magnetic resistance is minimized and consequently a high efficiency can be obtained from the electric motor 42. In this arrangement of the first pump member 24 and rotor 46 in FIG. 5, the number of pole pairs of the rotor is thus equal to the number of teeth of the first pump member. The number of pole pairs could also be twice this or preferably an integral and, in particular, even-numbered multiple thereof. In this case too, the advantage described above would be achieved as before, although possibly not in this form.

The invention claimed is:

1. A pump arrangement for delivering a lubricating fluid to a component of a motor vehicle, comprising:

a housing;

a first rotatably mounted pump member disposed in the housing;

a second rotatably mounted pump member disposed in the housing, wherein a delivering effect of the lubricating fluid is produced by means of a relative rotary movement between the first and the second pump member;

an electric motor arranged concentrically with the first pump member and which has a stator and a rotor, wherein the rotor is fixed to the first pump member for driving the first pump member; and an annular gap defined between the rotor and the stator for containing the lubricating fluid;

wherein the rotor has a lower thermal conductivity than the first pump members;

wherein the rotor is a ring element having a plurality of magnets and surrounds an outer circumference of the first pump member;

wherein the ring element further includes a first heat insulating layer disposed radially between the magnets and the annular gap to define the annular gap between the inner surface of the stator and an outer surface of the first heat insulating layer for reflecting heat arising from the stator to hold the heat in the annular gap to heat the lubricating fluid in the annular gap to provide improved cold starting to the pump arrangement.

2. The pump arrangement as claimed in claim 1, wherein the stator has at least one stator pole on which an electric stator winding is arranged, and wherein the the at least one stator pole directly adjoins the annular gap.

3. The pump arrangement as claimed in claim 1, wherein the first pump member is produced from a metallic material.

4. The pump arrangement as claimed in claim 1, wherein the rotor generally has a ring shape.

5. The pump arrangement as claimed in claim 4, wherein the rotor has a plurality of magnets distributed over the circumference of the rotor.

6. The pump arrangement as claimed in claim 5, wherein a second heat insulating layer is disposed radially between the magnets and the first pump member.

7. The pump arrangement as claimed in claim 6, wherein the first and second heat insulating layers are comprised of one of a plastics material, a synthetic resin material or a ceramic material.

8. The pump arrangement of claim 5 wherein the first heat insulating layer is entirely disposed radially outwardly away from the plurality of magnets toward the gap.

9. The pump arrangement as claimed in claim 4, wherein the first pump member presents a plurality of internal teeth extending radially inwardly and the second pump member defines a plurality of external teeth extending radially outwardly for meshing with the internal teeth of the first pump member; the rotor includes a plurality of rotor magnet pole pairs disposed circumferentially about the rotor, and wherein the number of pole pairs of the rotor is equal to the number of internal teeth of the first pump member or to an integral multiple thereof.

10. The pump arrangement as claimed in claim 1, wherein the housing has a first housing section and a second housing section which are arranged on axially opposite sides of the pump members, and wherein one of the housing sections is formed by a circuit board arrangement that is fluidtight with respect to the interior of the housing.

11. The pump arrangement as claimed in claim 1, wherein the fluid contained in the annular gap is an oil.

12. The pump arrangement as claimed in claim 1, wherein the first and the second pump members form an annular gear pump.

13. The pump arrangement as claimed in claim 1, wherein at least one rotor position sensor is positioned directly on the stator.

14. The pump arrangement as claimed in claim 13, wherein the at least one stator pole includes a plurality of stator poles, and wherein the space between at least two of the plurality of stator poles of the stator is filled with an electrically insulating material.

15. The pump arrangement as claimed in claim 14, wherein the rotor position sensor is positioned directly on the stator between two of the stator poles.

16. A pump arrangement for conveying a lubricating fluid to a component of a motor vehicle, comprising:

a housing;

a gear pump rotatably supported in the housing and including a first pump member and a second pump member, wherein a—pumping effect of the lubricating fluid is produced in response to relative rotation between the first and second pump members;

an electric motor adapted to rotatably drive the first pump member, the electric motor including a stator and a rotor, the stator being fixed to the housing and arranged concentrically with respect to the first pump member, the rotor being fixed to the first pump member and configured to define an annular gap with the stator, wherein the lubricating fluid is present in the annular gap between the stator and rotor, and wherein the rotor has a lower thermal conductivity than the first pump member;

wherein the stator includes a stator core having a plurality of radially aligned stator poles, windings surrounding the stator poles, and an electrically insulating material provided between adjacent stator poles, and wherein the stator includes a cylindrical inner surface formed alternately by terminal ends of the stator poles and the electrically insulating material;

wherein the rotor is a ring element having a plurality of magnets and surrounds an outer circumference of the first pump member;

wherein the ring element further includes a first heat insulating layer disposed radially between the magnets and the annular gap to define the annular gap between the inner surface of the stator and an outer surface of the first heat insulating layer for reflecting heat arising from the stator to hold the heat in the annular gap to heat the lubricating fluid in the annular gap to provide improved cold starting to the pump arrangement.

17. The pump arrangement of claim 16 wherein the rotor position sensor is positioned directly on the stator between two of the stator poles.

18. The pump arrangement of claim 16 wherein the rotor further includes a second heat insulating layer disposed between the magnetic poles and the first pump member.

* * * * *